US012808060B2

(12) United States Patent
Garcia et al.

(10) Patent No.: US 12,808,060 B2
(45) Date of Patent: Nov. 24, 2026

(54) DEVICE FOR CATHODIC PROTECTION OF A METAL STRUCTURE AGAINST CORROSION

(71) Applicants: CORROHM, Ramoniville saint Agne (FR); Institut National des Sciences Appliquées de Toulouse, Toulouse (FR); Institut National Polytechnique de Toulouse, Toulouse (FR); Centre National de la Recherche Scientifique, Paris (FR); Université Toulouse III—Paul Sabatier, Toulouse (FR)

(72) Inventors: David Garcia, Ramonville-saint-Agne (FR); Julie Dubuit, Ramonville-saint-Agne (FR); Alexandra Bertron, Toulouse (FR); Stéphane Laurens, Toulouse (FR); Benjamin Erable, Toulouse (FR); Luc Etcheverry, Toulouse (FR)

(73) Assignees: CORROHM, Ramoniville saint Agne (FR); INSTITUT NATIONAL DES SCIENCES APPLIQUÉES DE TOULOUSE, Toulouse (FR); INSTITUT NATIONAL POLYTECHNIQUE DE TOULOUSE, Toulouse (FR); CENTRE NATIONAL DE LA RECHERCHE SCIENTIFIQUE, Paris (FR); UNIVERSITÉ TOULOUSE III, Toulouse (FR); Paul Sabatier, Toulouse (FR)

( * ) Notice: Subject to any disclaimer, the term of this patent is extended or adjusted under 35 U.S.C. 154(b) by 521 days.

(21) Appl. No.: 18/534,019

(22) Filed: Dec. 8, 2023

(65) Prior Publication Data

US 2025/0188619 A1 Jun. 12, 2025

(51) Int. Cl.

| | |
|---|---|
| ***C23F 13/10*** | (2006.01) |
| ***E01D 19/02*** | (2006.01) |
| ***E01D 101/26*** | (2006.01) |

(52) U.S. Cl.
CPC ..... *C23F 13/10* (2013.01); *E01D 19/02* (2013.01); *E01D 2101/26* (2013.01)

(58) Field of Classification Search
CPC ..... C04B 2111/265
See application file for complete search history.

(56) References Cited

U.S. PATENT DOCUMENTS

| | | | |
|---|---|---|---|
| 9,365,936 B2 | 6/2016 | de Pierola | |
| 2012/0234692 A1 | 9/2012 | Bell | |
| 2020/0087799 A1 | 3/2020 | Van Delden | |

FOREIGN PATENT DOCUMENTS

| | | | | |
|---|---|---|---|---|
| CN | 110257832 A * | 9/2019 | ..... | H01M 8/16 |
| CN | 111534822 A * | 8/2020 | ..... | C23F 13/06 |

(Continued)

OTHER PUBLICATIONS

European Extended Search Report for European Patent Application No. 22177625.5 dated Mar. 6, 2023.

(Continued)

*Primary Examiner* — Alexander W Keeling
(74) *Attorney, Agent, or Firm* — Chrisman Gallo Tochtrop LLC

(57) ABSTRACT

A device for cathodic protection against corrosion of at least one metal structure in contact with an electrolytic medium comprising a sedimentary soil, the protective device dispensing with the need for a sacrificial metal and means for connection to an electrical distribution network and including at least two microbial anode systems including microorganisms and an electrode configured to be in contact with the microorganisms and the electrolytic medium, the microorganisms having the ability to supply electrons to the (Continued)

electrode by degradation of oxidizable ambient resources according to oxidation-reduction reactions, the electrode of each microbial anode system being configured to be buried at least partially in the sedimentary soil of the electrolytic medium and the free electrochemical potential of the microbial anode system is lower than the free electrochemical potential of the metal of the metal structure to be protected.

6 Claims, 4 Drawing Sheets

(56) References Cited

FOREIGN PATENT DOCUMENTS

| | | | | |
|---|---|---|---|---|
| EP | 4101944 | A2 | 12/2022 | |
| FR | 3123662 | A1 | 12/2022 | |
| JP | 6071053 | B2 | 2/2017 | |
| WO | WO-2010031961 | A1 * | 3/2010 | ..... H01M 4/90 |

OTHER PUBLICATIONS

French Preliminary Search Report for French Patent Application No. 2106008 dated Feb. 21, 2022.

Shamsuddin Raba'atun Adawiyah et al, "Can electrochemically active biofilm protect stainless steel used as electrodes in bioelectrochemical systems in a similar way as galvanic corrosion protection?", International Journal of Hydrogen Energy, Elsevier, Amsterdam, NL, vol. 44, No. 58, doi: 10.1016/J.IJHYDENE.2019.03.089, ISSN 0360-3199, (Apr. 16, 2019), pp. 30512-30523, (Apr. 16, 2019), XP085898880 [A] 1-6 * abstract * * Conclusions; p. 30519; figure 4 * * Introduction; p. 30512-p. 30514 *.

Kung Chih-Chien et al, "Innovative microbial fuel cell for energy harvesting and corrosion protection", Energy Harvesting and Storage: Materials, Devices, and Applications II, SPIE, 1000 20th St. Bellingham WA 98225-6705 USA, (May 13, 2011), vol. 8035, No. 1, doi: 10.1117/12.886565, pp. 1-11, XP060015079 [A] 1-6 * 2. Materials and Methods; p. 2-p. 4; figure 1 *.

* cited by examiner

[Fig. 1]
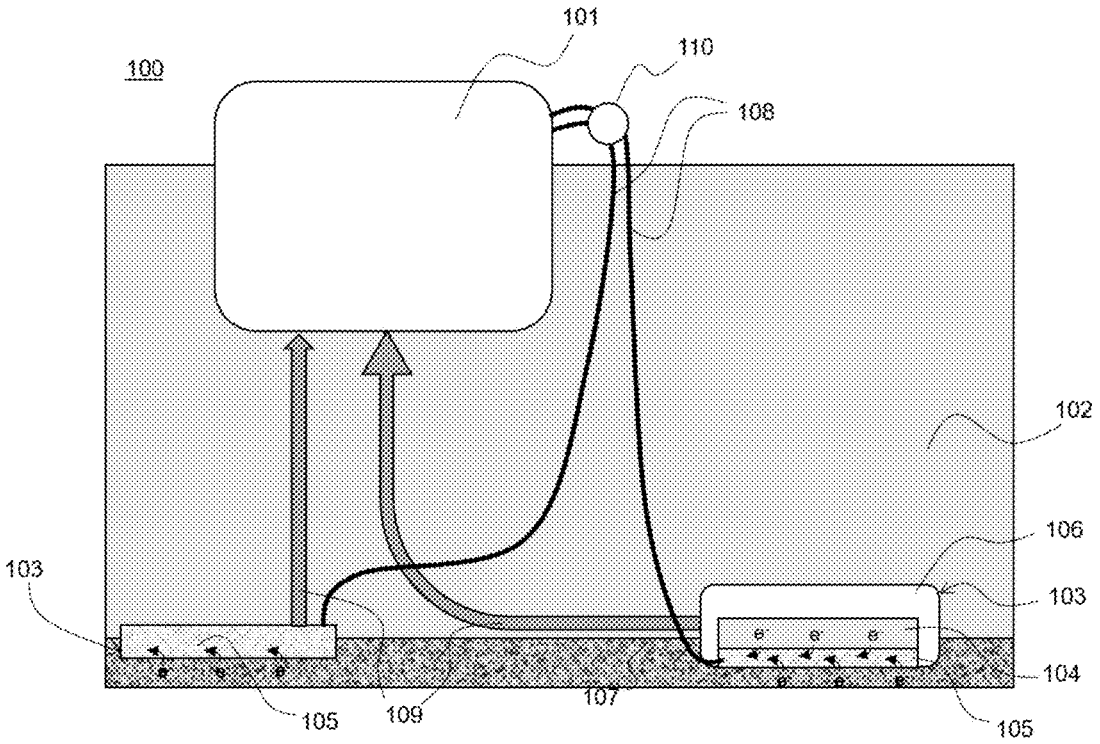
[Fig. 2]
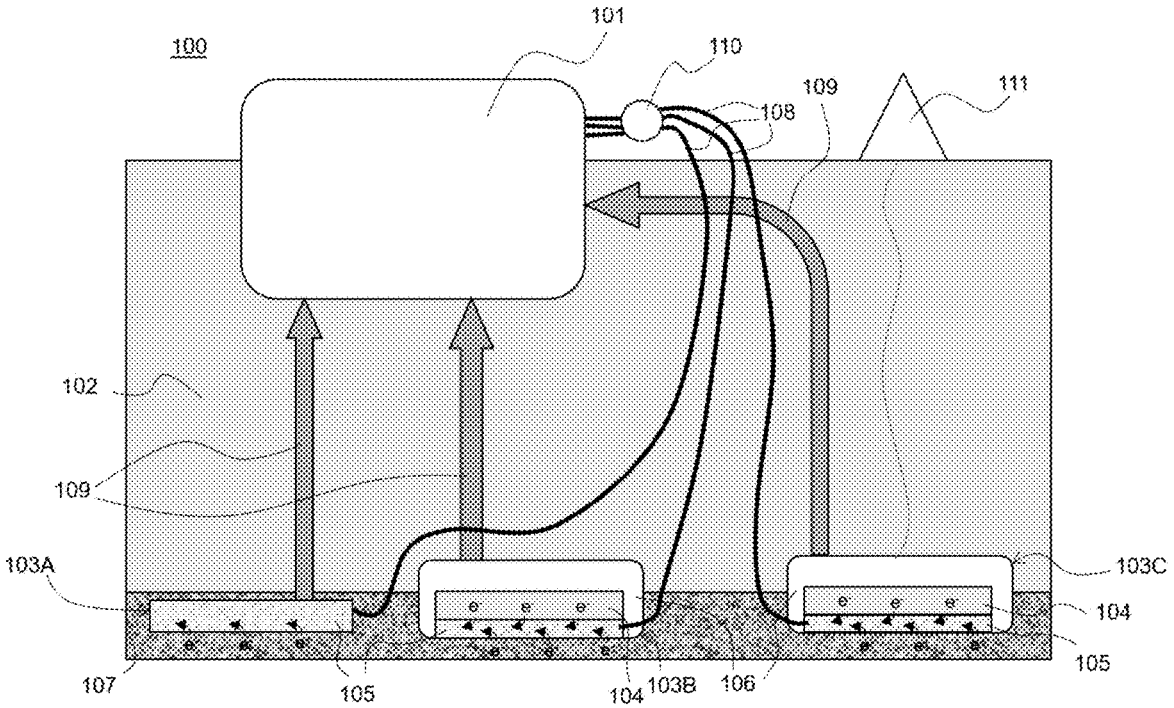

[Fig. 3]
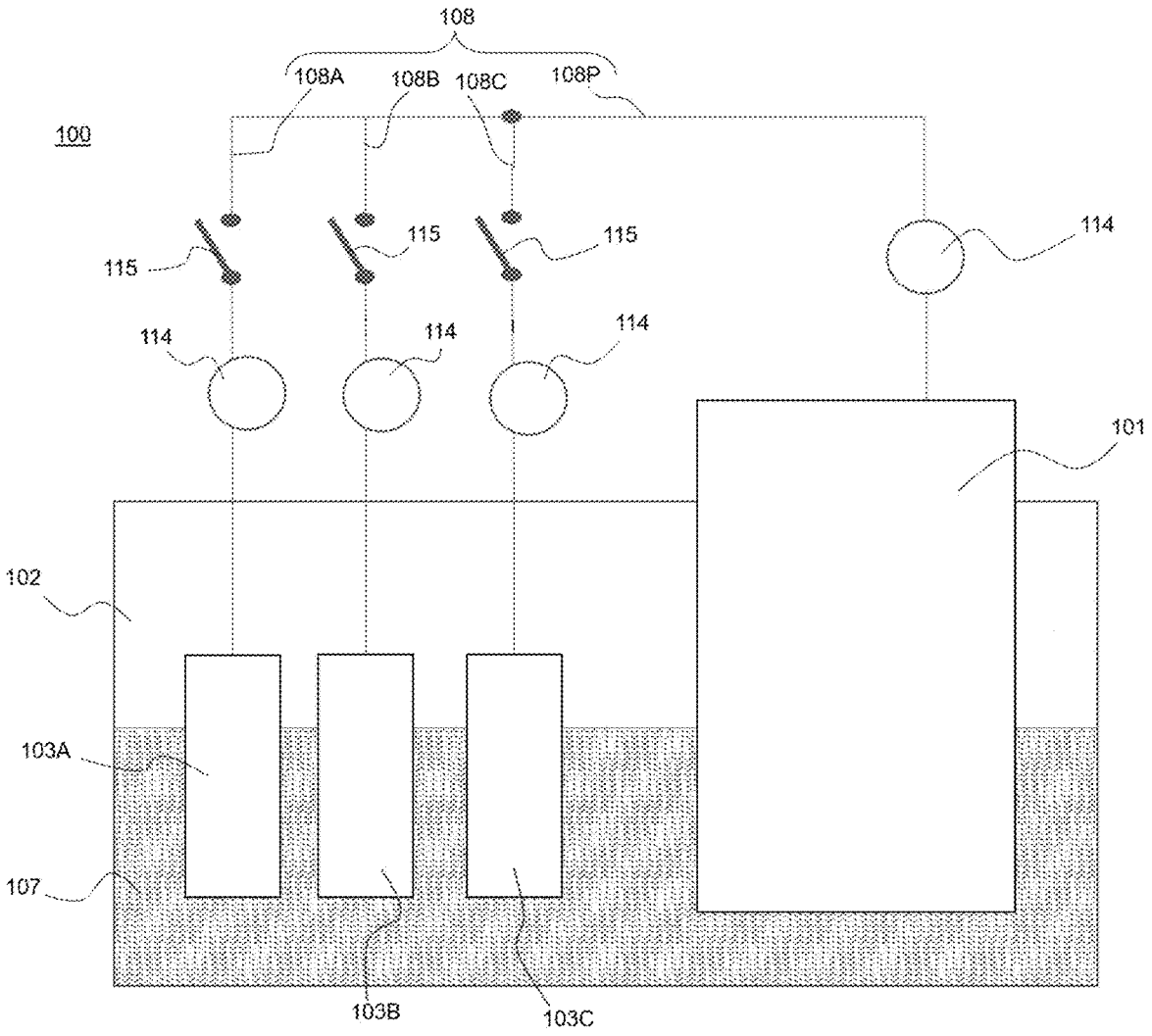

[Fig. 4]
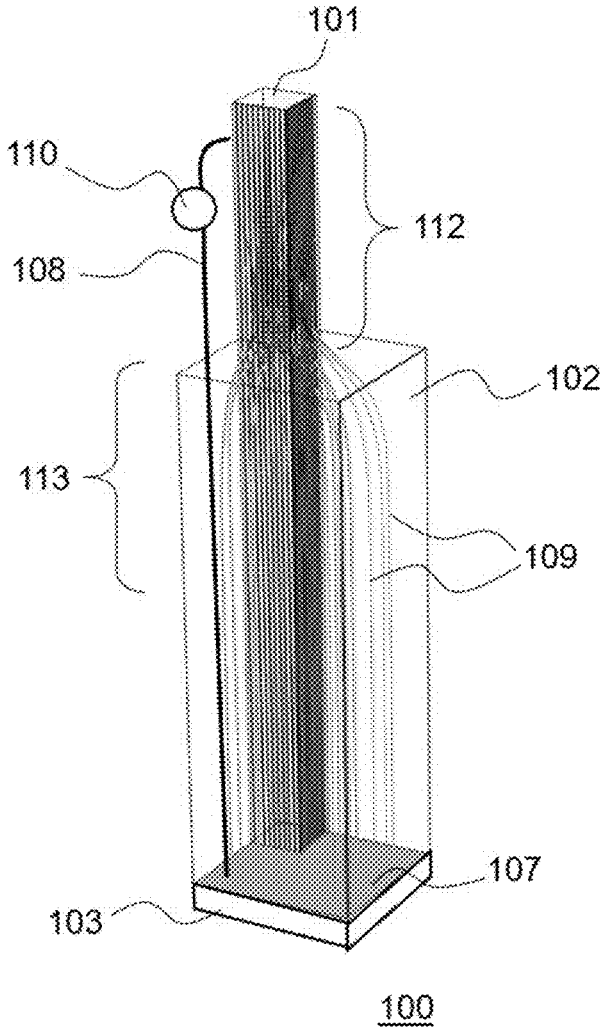

[Fig. 5]
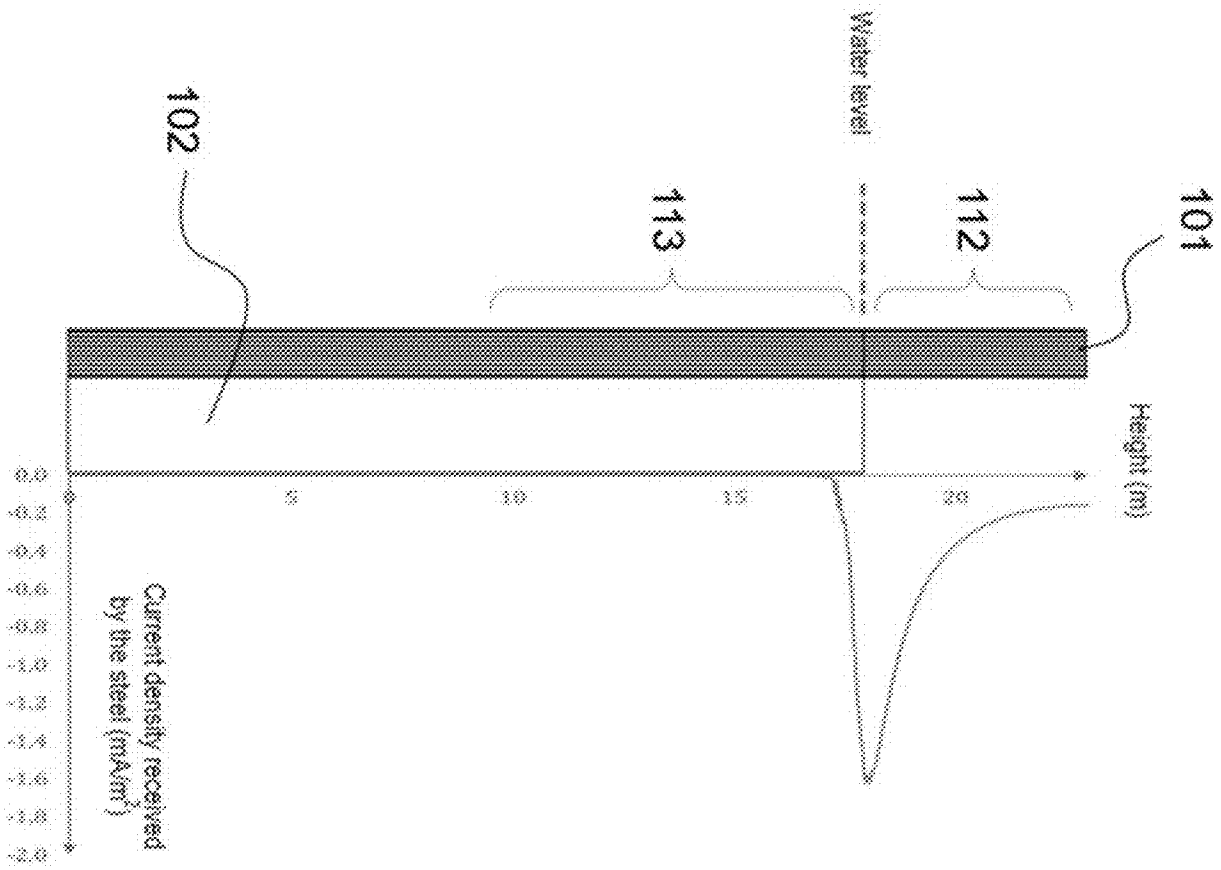

DEVICE FOR CATHODIC PROTECTION OF A METAL STRUCTURE AGAINST CORROSION

TECHNICAL FIELD OF THE INVENTION

The invention relates to devices/methods for protecting metal structures against corrosion. It pertains to the field of cathodic protection, and relates more particularly to a device and a method for cathodic protection against corrosion of a metal structure in contact with an electrolytic medium.

PRIOR ART

Corrosion is the primary cause of accelerated degradation of metal structures in direct contact with an electrolytic environment. Amongst the preventive and curative solutions associated with this pathology, cathodic protection has been developing for many years in all industrial sectors concerned by this problem.

The basic principle of cathodic protection simply consists in supplying electrons in a sufficient amount to the metal to be protected. The amount of electrons to be supplied depends on several factors, such as:

- the kinetics and the patterns of corrosion of the metal, whether measured or assumed,
- the environmental context of the metal to be protected, in physical, chemical and mechanical terms, etc.

The necessary electrons are supplied by means of a so-called "anodic" device or system. Depending on the type of anode system, there are nowadays two main families of cathodic protection techniques.

The first family corresponds to galvanic current cathodic protection (GCCP). This protection involves an anode system which consists of a sacrificial metal which is less noble than the metal to be protected (for example zinc or magnesium for the protection of carbon steel structures). A galvanic coupling between the metal to be protected and the sacrificial metal is made. This coupling is favorable to the metal to be protected since the sacrificial metal (less noble) is consumed by galvanic corrosion and thus supplies the metal to be protected with electrons. The energy is naturally (i.e. spontaneously) supplied by the consumption (by corrosion) of the sacrificial metal for the benefit of the metal to be protected. The service life of the protection system is determined by the amount of sacrificial metal implemented and the rate of consumption of the latter. Extending the service life of such a protection system requires periodic resupply with sacrificial metal. The drawbacks of this protection solution lie in the consumption of natural metal resources (metal consumable) and the release of metal oxides into the environment.

A GCCP example is given in the patent application JP 6 071053 B2 which discloses a device for cathodic protection of a metallic material of a structure in contact with water comprising at least one sacrificial anode arranged in the water close to the structure whose metallic material is to be protected. This sacrificial anode is connected by an electrical circuit to the metallic material of the structure and it has a greater tendency to ionization than that of the metallic material. The cathodic protection device also includes a second anode installed in the anaerobic soil at the bottom of the water near the structure. This second anode is connected to the sacrificial anode or to the metallic material of the structure by the electrical circuit and via a rectifier device which is only powered when the second anode is at a low potential compared to the sacrificial anode or the metallic material. Thus, the wear of the sacrificial electrode could be reduced and the service life of the cathodic protection could be extended. The second anode collects electrons released by the microorganisms present in the anaerobic soil and transfers them to the sacrificial anode or to the metallic material of the structure.

Another example is given in the patent U.S. Pat. No. 9,365,936 B2 which discloses a semi-circuit system, a method and an apparatus intended to protect metallic elements immersed in an electrolytic fluid against electrochemical corrosion. The apparatus comprises a case to which a sacrificial anode is fastened, an electrically-conductive cord electrically connected to the anode and an electrical connector allowing connecting the cord to a metal structure to be protected against corrosion. The case may be positively buoyant, which allows protecting nearby structures from damages caused by impacts, while shielding the anode component from sunlight, which allows reducing the rate of development of stains of marine origin thereon.

Still another example is given in the patent application US 2012/234692 A1 which discloses an anode for the cathodic protection of underwater equipment. The anode comprises a support body, a sacrificial material retained by the support body, and a fastening mechanism for removably fastening the anode to the underwater equipment. The support body may comprise flotation means to allow selecting the density of the anode and thus allow easier handling of the latter in great underwater depths.

The second family corresponds to impressed current cathodic protection (ICCP). In this protection, the anode system consists of an inert metal or metal complex, generally more noble than the metal to be protected. The electrons are not herein supplied by the oxidation of a metal, but by an electrochemical reaction occurring at the interface between the electrolytic medium and the anode system. This process is not spontaneous, a direct current generator (transformer-rectifier) and connection thereof to the electrical distribution network are necessary to force the transport of electrons towards the metal to be protected. Hence, energy is supplied by a permanent connection to the electrical distribution network throughout the service life of the protection system. The service life of an ICCP system is theoretically longer than a GCCP system. The drawback of ICCP solutions lies in the electric power consumption necessary to continuously supply electrons to the metal to be protected.

The cathodic protection of a metal structure represents a considerable financial cost related to quite heavy and complex in situ implementation processes, to the raw materials consumed (in particular in the case of sacrificial metals used in GCCP) or to connection to the electrical distribution network throughout the service life of the system in the case of ICCP. For this reason, the implementation of a cathodic protection remains relatively limited to cases:

- of sensitive metal structures for which there is no other efficient solution,
- of specific metal structures for which cathodic protection is required by standards.

Hence, it seems nowadays necessary to find a more economical and ecological cathodic protection solution.

Some cathodic protection devices do not require sacrificial materials and connection to an electrical distribution network.

For example, the patent application CN 111 534 822 A describes a cathodic protection device for deep-sea equipment, said cathodic protection device comprising deep-sea equipment, a bottom support arranged under the deep-sea equipment and one or more bio-anode(s) arranged under the bottom support. The bio-anode is formed of carbon brushes which are in contact with electricity-generating bacteria and said bio-anode is partially inserted into the sediments of the seabed. The bio-anode is connected to the deep-sea equipment by a cable and the electricity-generating bacteria react with the seabed sediments to ensure cathodic protection of the equipment. When the deep-sea equipment lands on the seabed, the bottom support supports the deep-sea equipment and avoids direct contact of the latter with the seabed. Inserted in the marine sediments, the electricity-producing bacteria on the carbon bio-anode can permanently use the degradable organic matter in the marine sediments to permanently supply a cathodic protection current to the deep-sea equipment.

Another example is found in the patent application CN 110 257 832 A which discloses a bio-electrochemical device for cathodic protection of a pipeline buried in sediments allowing dispensing with the need for a sacrificial anode. The pipeline acts as a cathode of the device and said device includes an anode in the form of an envelope around the pipeline, the anode and the cathode being separated by a proton-exchange medium such as a proton-exchange membrane. The anode and the cathode are connected by an external circuit. The anode is enriched with electrogenic microorganisms capable of degrading organic matter and of supplying electrons to the anode which are then transmitted to the cathode via the external circuit, thereby protecting the cathode against corrosion. The protons generated at the anode and the microorganisms are transmitted to the cathode via the proton-exchange medium. Preferably, the microorganisms used to enrich the anode are the microorganisms present in the sediments in which the pipeline and the device are buried.

Such devices are more economical and ecological than those of the ICCP and GCCP families, however these two aspects should be improved in order to avoid depletion of the natural resources they use to operate.

DISCLOSURE OF THE INVENTION

To this end, an objective of the present invention is to overcome the aforementioned drawbacks by providing a device for cathodic protection against corrosion of at least one metal structure in contact with an electrolytic medium comprising a sedimentary soil, said protective device dispensing with the need for a sacrificial metal and connection to an electrical distribution network and including:

- at least two microbial anode systems each comprising microorganisms and an electrode configured to be in contact with said microorganisms and said electrolytic medium, said microorganisms having the ability to supply electrons to the electrode by degradation of oxidizable ambient resources following oxidation-reduction reactions, the electrode of each microbial anode system being configured to be buried at least partially in said sedimentary soil of the electrolytic medium and the free electrochemical potential of said microbial anode system being lower than the free electrochemical potential of the metal of said at least one metal structure to be protected;
- at least one connecting means configured to connect each microbial anode system to said at least one metal structure and configured to let the electrons circulate from the electrode of each microbial anode system up to said at least one metal structure;

so that a protective galvanic current is applied through the electrolytic medium from at least one of the microbial anode systems up to said at least one metal structure when said at least one microbial anode system is in contact with said electrolytic medium and is connected by said at least one means for connection to said at least one metal structure, said protective device being characterized in that it further includes:

- a system for measuring the current of electrons circulating in each connecting means allowing determining the variations in depletion of the oxidizable ambient resources which are in the environment close to the microbial anode system to which the connecting means is connected,
- a control system allowing stopping and activating the circulation of the current of electrons circulating in each connecting means.

By microbial anode system, it should be understood a system with a design close to the anodic portion of microbial batteries, also called biocells or microbial fuel cells, and which generates electricity autonomously from the oxidation reactions carried out by microorganisms and known to a person skilled in the art. Each of the microbial anode systems used in the present invention includes microorganisms and an electrode which serves as an anode in the protective device of the present invention. For example, this electrode is made of graphite.

The free electrochemical potential of said microbial anode system is lower than the free electrochemical potential of the metal of said at least one metal structure to be protected. The free electrochemical potential of said microbial anode system depends, inter alia, on the microorganisms contained in the microbial anode system. To this end, the microorganisms contained in each microbial anode system are selected from among microorganisms enabling the microbial anode system to have a free electrochemical potential lower than the free electrochemical potential of the metal of said at least one metal structure to be protected.

From the oxidation-reduction reactions involved in the degradation of ambient oxidizable resources (for example organic chemical molecules), the microorganisms, for example bacteria, release electrons which are transferred to the electrode (anode), the latter being connected by the means for connection to at least one metal structure to be protected, which serves as a cathode. The microorganisms of the microbial anode systems of the present invention include microorganisms present in the sedimentary soil of the electrolytic medium. The sedimentary soil of the electrolytic media, preferably natural electrolytic media such as a sea, an ocean, a lake or a river, is composed of sediments advantageously rich in microorganisms and in biodegradable substrates (oxidizable resources) part of the available energy of which is transformed into electricity by the microorganisms.

By electrolytic medium, it should be understood any aqueous medium containing mobile ions. Examples of electrolytic media in which the device object of the present invention can be implemented include seas, oceans, waterways, agricultural effluents, domestic and industrial wastewater, soils, bio-waste.

The cathodic protection device including several microbial anode systems means, by "at least one connecting means", it should be understood that either the cathodic protection device includes one single connecting means connecting all of the microbial anode systems and the metal structure, or that the cathodic protection device includes several connecting means, and for each connection between a microbial anode system and the metal structure, one single distinct connecting means is used.

In the presence of several metal structures to be protected, by "at least one connecting means", it should be understood that the cathodic protection device includes a distinct connecting means connecting each metal structure and said at least two microbial anode systems.

By metal structure, it should be understood any structure including metal. For example, metal structures as used in the present invention include a sheet pile, a pile, an off-shore wind turbine float, a bridge or quay pier, a retaining wall or veil, a box, a quay beam, a jetty, a barge, an element of a sanitation infrastructure, any element of a reinforced concrete structure, etc.

This protection system allows creating a protective galvanic current which is naturally exchanged through the electrolytic medium in the form of an ionic flow between the microbial anode system and each metal structure connected to the latter. Hence, the metal structure(s) is/are advantageously protected from corrosion.

The positioning distance of each microbial anode system with respect to the metal structure to be protected is directly dependent on the conductivity of the electrolytic medium. The more conductive the environment, the farther the microbial anode systems can be placed from the metal structure to be protected. At an equivalent distance, an anode system protects a larger "amount" of the metal structure to be protected when the conductivity of the electrolytic medium increases. Hence, in the present invention, each microbial anode system is placed at a distance from the metal structure to be protected according to the conductivity of the electrolytic medium so as to enable the creation of the protective galvanic current through said electrolytic medium.

The advantages conferred by the device of the present invention are multiple, both from an economic point of view (for a project owner) and an environmental point of view. Indeed, this device advantageously exploits a source of free renewable electrical energy. In addition, it is not harmful to the environment since it does not implement any metal consumables nor does it cause any release of metal oxides into the environment, unlike the cathodic protection involving a sacrificial metal. Another advantageous point from an environmental point of view is that it also does not involve any connection to the electrical distribution network, unlike impressed current cathodic protection. Advantageously, this device is easy to implement and its installation cost is reduced compared to cathodic protection systems known from the prior art.

Advantageously, the presence of several microbial anode systems within the cathodic protection device enables them to be alternately used so that this allows not depleting the ambient oxidizable resources in the close environment of a microbial anode system and that the microorganisms of said microbial anode system degrade. Indeed, it is thus possible to make the cathodic protection device operate with a first microbial anode system for a given time and, when it is noticed that the natural ambient oxidizable resources in the environment close to this first microbial anode system have exceeded a given depletion threshold, stop operating the cathodic protection device with this first microbial anode system and make it operate with a second microbial anode system positioned at a location other than the first microbial anode system, while the environment close to the first microbial anode system is naturally or artificially replenished with ambient oxidizable resources. It is also possible to use several microbial anode systems simultaneously.

By analyzing the current of electrons circulating in a connecting means, the measurement system also advantageously allows knowing the variations in depletion of the oxidizable ambient resources in the environment close to a microbial anode system to which the connecting means is connected. This analysis may be automated and to this end, according to a preferred embodiment, the cathodic protection device includes, instead of the system for measuring the current of electrons circulating in each connecting means, a system for measuring the current of electrons circulating in each connecting means and for determining the variations in depletion of the oxidizable ambient resources in the environment close to each microbial anode system to which said at least one connecting means is connected. The system for measuring the current of electrons circulating in each connecting means and for determining the variations in depletion of the oxidizable ambient resources, thus allows determining whether a predetermined threshold of depletion of oxidizable ambient resources in the environment close to each microbial anode system is reached.

Advantageously, the control system allows stopping or activating the cathodic protection by respectively stopping or activating the circulation of the current of electrons in a connecting means. By stopping the circulation of the current of electrons in a connecting means, the control system allows no longer depleting or substantially reducing the depletion of the oxidizable ambient resources in the close environment of a microbial anode system to which the connecting means is connected and which are degraded by the microorganisms included in the microbial anode system. Stopping the circulation of the current of electrons circulating in a connecting means also allows measuring the depolarization of the metal structure in order to assess the performance of the cathodic protection device within the meaning of the standard EN ISO 12696.

The control system may further be configured to stop the circulation of electrons in a connecting means connecting a microbial anode system to the metal structure to be protected, when a predetermined threshold of depletion of oxidizable ambient resources in the environment close to said microbial anode system is reached and determined thanks to the measuring system or thanks to the system for measuring the current of electrons circulating in each means for connection and for determining the variations in depletion of the oxidizable ambient resources in the environment close to each microbial anode system.

Thanks to the system for measuring the current of electrons circulating in a connecting means or for measuring the current of electrons circulating in a means for connection and for determining the variations in depletion of the oxidizable ambient resources, and to the control system, the cathodic protection device is ecological in that it respects the environment by avoiding depleting the oxidizable resources of the sediments which are important for many organisms and microorganisms living in the electrolytic medium.

In particular embodiments, the invention also meets the following features, implemented separately or in each of their technically feasible combinations.

According to one embodiment, the microorganisms of the microbial anode systems are at least microorganisms present in the electrolytic medium and in particular microorganisms present in the sediments. Thus, from the oxidation-reduction reactions involved in the degradation of ambient oxidizable resources naturally present in the electrolytic medium, the microorganisms can release electrons which are transferred to the electrode of each microbial anode system. In some embodiments, the microorganisms of the microbial anode systems include microorganisms present in the electrolytic medium, in particular microorganisms present in the sediments, and other microorganisms previously selected by the user of the cathodic protection device. Preferably, these other microorganisms are in the form of a biofilm of microorganisms. For example, the microorganisms are bacteria and can be supplied in the form of a bacterial biofilm. Preferably, the biofilm is affixed to the electrode of the microbial anode system.

In particular embodiments of the invention, at least one microbial anode system comprises a chamber comprising the electrode and the microorganisms, said chamber being configured to receive oxidizable resources that are degradable by the microorganisms of the microbial anode system. This embodiment has the advantage of enabling an operator of the cathodic protection device to supply oxidizable resources into the chamber for the microorganisms contained therein.

According to some embodiments, the chamber is permeable to the electrolytic medium. In these embodiments, the microorganisms of the microbial anode system are at least those naturally present in the electrolytic medium, particularly the sediments, and the chamber also comprises ambient oxidizable resources (oxidation of chemical molecules) naturally present in the electrolytic medium.

According to a preferred embodiment of the present invention, the system for measuring the current of electrons circulating in each connecting means or for measuring the current of electrons circulating in each means for connection and for determining the variations in depletion of the oxidizable ambient resources, and the control system, are included in a control apparatus of the cathodic protection device.

In particular embodiments of the invention, the protective galvanic current is distributed in the metal structure at a density comprised between 0.2 $mA/m^2$ and 100 $mA/m^2$, preferably between 0.2 $mA/m^2$ and 20 $mA/m^2$. Advantageously, such a distribution of the protective galvanic current in the metal structure covers the range of cathodic prevention against corrosion (0.2 to 2 $mA/m^2$) as well as the range of cathodic protection against corrosion (2 to 20 $mA/m^2$).

In particular embodiments of the invention, at least one microbial anode system is connected to a flotation device floating at the surface of the electrolytic medium. The fact that a microbial anode system is connected to a flotation device floating at the surface of the electrolytic medium offers the advantage of facilitating access to the microbial anode system for a manager of the metal structure to be protected who wishes to intervene on the microbial anode system, for example, to change its microorganisms or supply the microorganisms present in the microbial anode system with new oxidizable resources to be degraded or to change the positioning of the microbial anode system.

In particular embodiments of the present invention, the connecting means is a cable including at least one electron-conducting material enabling the circulation of electrons from said microbial anode system up to the metal structure to be protected. Preferably, the cable is a metal cable.

The present invention also relates to a method of cathodic protection against corrosion of at least one metal structure in contact with an electrolytic medium comprising a sedimentary soil implementing the cathodic protection device which object of the present invention and comprising the following steps of:

setting up several microbial anode systems, each microbial anode system comprising an electrode in contact with the electrolytic medium and microorganisms, each microbial anode system being configured to supply electrons to its electrode by degradation of oxidizable ambient resources carried out by said microorganisms, the electrode of each microbial anode system being buried at least partially in said sedimentary soil of the electrolytic medium and the free electrochemical potential of each microbial anode system being lower than the free electrochemical potential of the metal of said at least one metal structure to be protected;

connecting each microbial anode system with said at least one metal structure with at least one connecting means configured to let the electrons circulate from the electrode of each microbial anode system up to said at least one metal structure;

activating the circulation of electrons alternately over time between the electrodes of the bacterial anode systems and said at least one metal structure.

By activating the circulation of electrons alternately over time between the electrodes of the bacterial anode systems and the metal structure, it should be understood that the circulation of electrons in the connecting means is activated alternately over time (one connecting means after another).

An advantage of such an implementation of the method wherein the circulation of electrons in the connecting means is activated alternately and therefore wherein the cathodic protection device alternates from one microbial anode system to another to supply itself with electrons, is that it allows not to deplete the oxidizable ambient resources in the close environment of each microbial anode system and allows time for these oxidizable ambient resources to regenerate when a microbial anode system is not used.

In a preferred implementation of the cathodic protection method, the alternating activation step comprises the following sub-steps, preferably repeated:

activating the circulation of electrons in at least one connecting means connecting at least one microbial anode system to the metal structure;

stopping the circulation of electrons in said at least one connecting means connecting said at least one microbial anode system to the metal structure when a threshold of depletion of electrons circulating in said at least one connecting means is reached, and activating the circulation of electrons in at least one connecting means connecting at least one other microbial anode system to the metal structure.

For example, the activation of the circulation of electrons in at least one connecting means connecting at least one other microbial anode system to the metal structure may be carried out a few minutes or hours before the electron depletion threshold is reached or when the latter is reached or after the latter is reached.

The threshold of depletion of electrons circulating in said connecting means is determined beforehand and reflects the fact that a given threshold of depletion of oxidizable ambient resources in the environment close to the microbial anode system is reached. Thus, stopping the circulation of electrons in said connecting means connecting the microbial anode system to the metal structure is performed when a threshold of depletion of oxidizable ambient resources in the environment close to the microbial anode system is reached. By environment close to a microbial anode system, it should be understood a volume of the environment around the microbial anode system whose chemical composition is likely to be affected by the electrochemical and microbial reactions at the interface between the microbial anode system and the electrolytic medium.

BRIEF DESCRIPTION OF THE FIGURES

The invention will be better understood upon reading the following description, given as a non-limiting example, and made with reference to the figures which show:

FIG. 1 illustrates a diagram of an embodiment of the cathodic protection device object of the present invention comprising two microbial anode systems;

FIG. 2 illustrates a diagram of an embodiment of the cathodic protection device object of the present invention comprising three microbial anode systems;

FIG. 3 illustrates a diagram of an embodiment of the cathodic protection device object of the present invention comprising switches on the connecting means and a system for continuously measuring the current circulating in each connecting means.

FIG. 4 shows a cathodic protection device object of the present invention in which the metal structure to be protected is a reinforced concrete bridge pier;

FIG. 5 illustrates the cathodic protection device shown in FIG. 4 with a curve of the distribution of the density of the protective galvanic current as a function of the height of the metal structure.

In these figures, identical reference numerals from one figure to another designate identical or similar elements. Moreover, for clarity, the drawings are not plotted to scale, unless stated otherwise.

DESCRIPTION OF THE EMBODIMENTS

FIG. 1 illustrates a diagram of the device 100 for cathodic protection against corrosion of a metal structure 101 in contact with an electrolytic medium 102 comprising a sedimentary soil 107, according to an embodiment of the present invention, wherein the cathodic protection device 100 further includes two microbial anode systems 103 arranged in contact with the electrolytic medium 102 and configured to supply electrons by biodegradation of oxidizable ambient resources (oxidation of chemical molecules), the free electrochemical potential of each microbial anode system 103 being lower than the free potential electrochemical of the metal of the metal structure 101 to be protected.

Each microbial anode system 103 includes microorganisms. These microorganisms are at least those naturally present in the electrolytic medium 102 and can be supplemented by microorganisms supplied for example in the form of a biofilm 104 of microorganisms as shown in FIG. 1. Each microbial anode system 103 also includes an electrode 105 which serves as an anode in the cathodic protection device 100. The electrode 105 is buried at least partially in the sedimentary soil 107 of the natural electrolytic medium 102 so that the microorganisms contained in the microbial anode system 103 are at least those of said soil 107. In turn, the metal structure 101 serves as a cathode in the protective device 100.

Each microbial anode system 103 is capable of generating electricity autonomously from oxidation reactions of ambient oxidizable resources (chemical molecules) carried out by the microorganisms it contains. Indeed, said oxidation reactions result in the release and transfer of electrons to the electrode 105 included in the microbial anode system 103, thereby generating an electrical current in the electrode 105.

The sedimentary soil 107 of an electrolytic medium 102 (in general a natural electrolytic medium) is composed of microorganisms and sediments rich in oxidizable resources representing a target substrate for the biodegradation carried out by the microorganisms to create electricity.

In some embodiments, at least one of the microbial anode systems 103 includes a chamber 106 comprising the biofilm 104 of microorganisms and the electrode 105. This chamber 106 is configured so that microorganisms present in the biofilm 104 of microorganisms are in contact with the electrolytic medium 102 and preferably with the sedimentary soil 107. For example, such a configuration corresponds to the fact that the chamber 106 is permeable to the electrolytic medium 102. The chamber 106 is also configured to receive resources oxidizable by the microorganisms of the microbial anode system 103. This has the advantage of enabling an operator of the cathodic protection device 100 to bring oxidizable resources into the chamber 106 to supply the microorganisms that it includes in addition to the oxidizable resources present in the electrolytic medium 102 and the sedimentary soil 107 with which they are in contact.

The cathodic protection device 100 further includes a means 108 for connection between each microbial anode system 103 and the metal structure 101. This connecting means 108 is configured to let the electrons circulate from said microbial anode system 103 up to the metal structure 101. Of course, the connecting means 108 includes an electron-conducting material, for example a metal. For example, the connecting means 108 may be a cable including an electron-conducting core. By "a means for connection 108 between each microbial anode system 103 and the metal structure 101", it should be understood that either the cathodic protection device 100 includes one single connecting means 108 ensuring connection between all of the microbial anode systems and the metal structure 101 (not illustrated in the figures) or that the cathodic protection device 100 includes several connecting means 108, and for each connection between a microbial anode system 103 and the metal structure 101, a distinct unique connecting means 108 is used (as illustrated in the figures).

The connecting means 108 is in contact with the electrode 105. The electrons originating from the degradation by oxidation of the chemical molecules (oxidizable ambient resources) present in the electrolytic medium 102 and in particular the sediments which is carried out by the microorganisms of the microbial anode system 103 are transferred to the electrode 105. Afterwards, the electrons pass from the electrode 105 to the connecting means 108 and circulate in said connecting means 108 to get into the metal structure 101.

Thus, a protective galvanic current 109 is created through the electrolytic medium 102 between each microbial anode system 103 and the metal structure 101. Advantageously, this galvanic current 109 protects the metal structure 101 against corrosion.

If used indiscriminately, powering a cathodic protection device with a biogalvanic current could lead to the depletion of oxidizable ambient resources. An insufficient current would not allow protection of the structure against corrosion; conversely, an excessive current could lead to an unnecessary depletion of the microbial resource. Advantageously, the present invention allows controlling the current delivered by one or more microbial anode system(s).

The cathodic protection device 100 illustrated in FIG. 1 also includes a control apparatus 110 comprising a system for measuring the current of electrons circulating in the connecting means 108 or for measuring the current of electrons circulating in each means for connection and for determining the variations in depletion of the oxidizable ambient resources, as well as a control system allowing stopping and activating the circulation of the current of electrons circulating in the connecting means 108. After having stopped the circulation of the current of electrons thanks to the control system, an operator of the cathodic protection device 100 will be able, using the measuring system, to advantageously measure the depolarization of the metal structure in order to assess the performance of the cathodic protection device within the meaning of the standard EN ISO 12696.

The exact number of microbial anode systems is calculated based on the kinetics of regeneration of oxidizable ambient resources. Control of the cathodic protection device (alternation of operation between the microbial anode systems) is based on two elements which are compliance with the performance standard criteria (cut-off current potential and depolarization) and compliance with a current criterion (a predetermined threshold not to exceed) in anticipation of depletion of oxidizable ambient resources (anticipation of non-compliance with the standard criteria).

According to an embodiment of the present invention, illustrated in FIG. 2, the cathodic protection device 100 includes several microbial anode systems 103 in contact with the electrolytic medium 102, preferably at least three. A first microbial anode system 103A does not include any chamber 106 whereas a second microbial anode system 103B and a third microbial anode system 103C include a chamber 106 comprising microorganisms preferably in the form of a biofilm 104 of microorganisms and an electrode 105. The cathodic protection device 100 comprises a means 108 for connection between each microbial anode system 103 and said metal structure 101, said connecting means 108 being configured to let the electrons circulate from the electrode 105 of the microbial anode system 103 which it connects to the metal structure 101 up to the latter. Each connecting means 108 is in contact with the electrode 105 of the microbial anode system 103 which it connects to the metal structure 101.

Thus, a protective galvanic current 109 is created through the electrolytic medium 102 between each microbial anode system 103 and the metal structure 101.

Each microbial anode system 103A, 103B, and 103C comprises an electrode 105 buried at least partially in the sedimentary soil 107 of the electrolytic medium 102 so that the microorganisms included in the microbial anode systems 103 are at least those of said electrolytic medium 102 and in particular those of the soil sediments 107. The third microbial anode system 103C is connected to a flotation device 111 configured to float in the electrolytic medium 102, preferably at the surface of the latter. For example, such a flotation device 111 may be a buoy. This has the advantage of facilitating access to the microbial anode system 103C if an operator of the cathodic protection device 100 wishes to access it, for example to perform a maintenance operation or a supply of resources oxidizable by the microorganisms or even a supply of microorganisms, for example a replacement of the biofilm 104.

The cathodic protection device 100 illustrated in FIG. 2 also comprises a control apparatus 110 comprising a system for measuring the current of electrons circulating in each connecting means 108 or means for measuring the current of electrons circulating in each means for connection and for determining the variations in depletion of the oxidizable ambient resources, as well as a control system allowing stopping and activating the circulation of the current of electrons circulating in each connecting means 108. Thus, the operator of the device can measure the current of electrons circulating in each connecting means 108 and he/she can also choose to stop or activate said current of electrons in each connecting means 108, which respectively stops or activates the protective galvanic current 109 between the anode system 103 and the metal structure 101 connected by said connecting means 108 in which the current is stopped or activated. Advantageously, this allows activating the circulation of current in the connecting means 108 alternately and therefore operating the cathodic protection device 100 while alternating from one microbial anode system 103 to another so as not to deplete the oxidizable ambient resources present in the close environment of a microbial anode system 103.

Whether the microorganisms are present in the electrolytic medium 102, for example in the sedimentary soil 107, or the microorganisms are supplied by the user into a microbial anode system 103, during the operation of the cathodic protection device 100, said microorganisms will progressively form a biofilm 104 of microorganisms at the surface of the electrode 105 which is reflected by a progressive increase in the current circulating in the connecting means 108 connecting said electrode 105 to the metal structure 101 up to a peak value. The local consumption of the oxidizable ambient resources of the electrolytic medium 102, in particular the sediments, carried out by the microorganisms of the microbial anode system 103, leads to a drop in the current circulating in the connecting means 108 connected to the electrode 105 of said microbial anode system 103. It is then relevant to change the microbial anode system 103 via the control system (for example electronically-controlled switches or relays) whose control is guided according to the aforementioned two criteria (standard performance criterion and current criterion in anticipation of depletion of the oxidizable ambient resources). As regards the current criterion, it may consist of a predetermined threshold value for depletion of the current (electrons) circulating in the connecting means 108. For example, this threshold value is a percentage of the assessed reduction in the current circulating in the connecting means 108 with respect to the peak value. When the threshold value is reached, the control system stops the circulation of current in the considered connecting means 108, thereby allowing stopping the microbial anode system 103 to which it is connected and therefore the natural renewal of the oxidizable ambient resources found in the environment close to the latter. In parallel or upstream, or still after, the control system activates the circulation of current in a connecting means 108 connecting another microbial anode system 103 to the metal structure 101 so that the cathodic protection against corrosion of the latter continues.

FIG. 3 illustrates a diagram of an embodiment of the cathodic protection device 100 which is the object of the present invention. The protective device 100 includes several microbial anode systems 103A, 103B and 103C buried at least partially in the sedimentary soil 107 of the electrolytic medium 102. The protective device 100 comprises a connecting means 108 comprising a main line 108P connected to the metal structure 101 and comprising a connection line 108A, 108B and 108C for each anode system, each connection line being connected to the main line 108P so that each microbial anode system 103 is connected to the metal structure 101. In this embodiment, the system for measuring the current of electrons circulating in each connecting means 108 or for measuring the current of electrons circulating in each means for connection and for determining the variations in depletion of the oxidizable ambient resources comprises an ammeter 114 arranged on each connection line 108A, 108B and 108C. Thus, it is possible to continuously measure the current circulating in each connection line 108A, 108B and 108C, which continuously indicates the current delivered by each microbial anode system 103 and allows determining the rate of depletion of the oxidizable ambient resources for each microbial anode system 103. Optionally, the system for measuring the current of electrons circulating in each connecting means 108 or for measuring the current of electrons circulating in each means for connection and for determining the variations in depletion of the oxidizable ambient resources also comprises an ammeter 114 arranged on the main line 108P.

The protective device 100 comprises a control system allowing stopping and activating the circulation of the current of electrons circulating in the connecting means 108. The control system comprises a switch 115 arranged on each connection line 108A, 108B and 108C. Thus, it is possible to cut (interruption of the flow of the current) and close (passage of the current) the switches 115 so as to preserve the weakest microbial anode systems 103 whose oxidizable ambient resources are about to be depleted and enable regeneration thereof by allowing them to rest. This also allows regulating the current by activating or deactivating some microbial anode systems 103 according to a predefined setpoint to better protect the metal structure 101. Thus, in a configuration with two microbial anode systems 103, the protective device 100 allows alternating the activation and deactivation of the microbial anode systems 103. In a configuration with more than two microbial anode systems 103, it is not only possible to preserve the microbial anode systems 103 and the oxidizable ambient resources from its close environment but also regulate the current per quantum of a microbial anode system 103.

Optionally, instead of switches 115 or in addition to each switch 115, the control system may comprise a variable resistor (not illustrated in the figures) thereby allowing varying the intensity of the current reaching the metal structure 101 from each microbial anode system 103.

Advantageously, the control system and the system for measuring the current of electrons circulating in each connecting means 108 or for measuring the current of electrons circulating in each means for connection and for determining the variations in depletion of the oxidizable ambient resources, may be automated and implemented into a control apparatus 110 such as a programmable controller or an industrial computer. In this case, the switches 115 may be replaced by programmable relays and the ammeters 114 by analog-to-digital converters. In particular, the measuring system may comprise a resistor shunted ("shunt" in English terminology) on each connection line 108A, 108B and 108C so as to measure the intensity of the current in each of these connection lines.

The cathodic protection obtained with the present invention has been tested with a particular embodiment of the invention, given herein for illustrative and non-limiting purposes. It consists of a cathodic protection device 100 according to the invention used for the protection of a metal structure 101 which is a reinforced concrete bridge pier in contact with an electrolytic medium 102, which is a marine environment, comprising a sedimentary soil 107. This bridge pier is a 25 m high concrete element having a 3×3 $m^2$ section and reinforced with 76 longitudinal steel rebars having a 32 mm diameter (FIG. 4). The metal structure 101 is immersed in sea water (the electrolytic medium 102) to a depth in the range of 18 m and rests on a seabed (the sedimentary soil 107) consisting of sediments rich in oxidizable resources for the microorganisms of the microbial anode systems 103, only one of these being illustrated in the FIG. 4. In this configuration type, the atmospheric concrete area or emerged area 112 is subject to the greatest levels of damage, due to a strong contamination by chlorides, concrete partially saturated with water and high oxygen availability. This area should be the priority target of the cathodic protection device 100. The drawdown area 113, which is an area that is partially submerged and partially emerged because of the difference in water level depending on the tides, goes down to a few meters below the water level (down to about 3 to 7 meters below the water level). The drawdown area 113 is also an area subject to high levels of damage. This vulnerability of the drawdown area is related to the problem of the water/air interface with a high oxygen availability, the reduction contributes to the corrosion phenomenon. The rest of the metal structure 101 immersed more deeply is very little subject to corrosion due to the very low content or absence of oxygen in the electrolytic medium 102.

One of the microbial anode systems 103 is positioned at the foot of the metal structure 101, at a depth of 18 m, buried in the sedimentary layer and connected to the steel rebar network of the bridge pier by means of a connecting means 108 which herein consists of an electric cable.

One could observe the protective galvanic current lines 109 (in light gray) in FIG. 4, naturally exchanged between the microbial anode system 103 and the steel rebar network of the reinforced concrete bridge pier. It should be noted that, because of the absence of oxygen at depth, the galvanic current lines 109 rise vertically and penetrate the concrete near the water surface.

FIG. 5 illustrates the distribution of the protective galvanic current 109 as a function of height in the bridge pier. For the above-mentioned reasons, one could observe that the protective current tends to concentrate in the oxygen-rich areas, which also correspond to the emerged 112 and drawdown 113 areas, which should be protected in priority.

The test has been reproduced with various depths for the positioning of the microbial anode system 103, without any significant impact on the amount and distribution of the protective galvanic current 109 towards the emerged 112 and drawdown 113 areas, which should be protected in priority.

More generally, it should be noted that the implementations and embodiments of the invention considered hereinabove have been described as non-limiting examples and that other variants are consequently possible.

What is claimed is:

1. A device for cathodic protection against corrosion of at least one metal structure in contact with an electrolytic medium comprising a sedimentary soil, said protective device dispensing with the need for a sacrificial metal and means for connection to an electrical distribution network, wherein said protective device comprises:

at least two microbial anode systems each comprising microorganisms and an electrode configured to be in contact with said microorganisms and said electrolytic medium, said microorganisms configured to supply electrons to the electrode by degradation of oxidizable ambient resources following oxidation-reduction reactions, the electrode of each microbial anode system being configured to be buried at least partially in said sedimentary soil of the electrolytic medium and the free electrochemical potential of each microbial anode system being lower than the free electrochemical potential of the metal of said at least one metal structure to be protected;

at least one connecting means configured to connect each microbial anode system to said at least one metal structure and configured to let the electrons circulate from the electrode of each microbial anode system up to said at least one metal structure;

so that a protective galvanic current is applied through the electrolytic medium from at least one of the microbial anode systems up to said at least one metal structure when said at least one microbial anode system is in contact with said electrolytic medium and is connected by said at least one means for connection to said at least one metal structure, wherein said protective device further comprises:

a system for measuring the current of electrons circulating in each connecting means allowing determining the variations in depletion of the oxidizable ambient resources which are in the environment close to the microbial anode system to which the connecting means is connected; and a control system allowing stopping and activating the circulation of the current of electrons circulating in each connecting means.

2. The device according to claim 1, wherein the microorganisms of the microbial anode system are at least microorganisms present in the electrolytic medium.

3. The device according to claim 1, wherein at least one microbial anode system comprises a chamber comprising the electrode and the microorganisms, said chamber being configured to receive oxidizable resources which are degradable by the microorganisms of the microbial anode system.

4. The device according to claim 1, wherein the protective galvanic current is distributed in the metal structure at a density comprised between 0.2 $mA/m^2$ and 100 $mA/m^2$, preferably between 0.2 $mA/m^2$ and 20 $mA/m^2$.

5. The device according to claim 1, wherein at least one microbial anode system is connected to a flotation device floating at the surface of the electrolytic medium.

6. A method of cathodic protection against corrosion of at least one metal structure in contact with an electrolytic medium implementing the cathodic protection device according to claim 1, said method comprising the following steps of:

setting up several microbial anode systems each comprising microorganisms and an electrode in contact with said microorganisms and the electrolytic medium, the microbial anode system being configured to supply electrons to the electrode by degradation of oxidizable ambient resources carried out by said microorganisms, the electrode of each microbial anode system being buried at least partially in said sedimentary soil of the electrolytic medium and the free electrochemical potential of said microbial anode system being lower than the free electrochemical potential of the metal of said at least one metal structure to be protected;

connecting said at least one metal structure with each microbial anode system with at least one connecting means configured to let the electrons circulate from the electrode of each microbial anode system up to said at least one metal structure;

activating the circulation of electrons alternately over time between each electrode of bacterial anode systems and said at least one metal structure, said activating comprising the sub-steps of:

activating the circulation of electrons in at least one connecting means connecting at least one microbial anode system to the metal structure so that a protective galvanic current is applied through the electrolytic medium from said at least one microbial anode system up to said at least one metal structure;

stopping the circulation of electrons in said at least one connecting means connecting at least one microbial anode system to the metal structure when a previously determined threshold of depletion of electrons circulating in said at least one connecting means is reached, said previously determined threshold reflecting a threshold of depletion in oxidizable ambient resources in the environment close to said at least one microbial anode system, and activating the circulation of electrons in at least one connecting means connecting at least one other microbial anode system to the metal structure.

* * * * *